United States Patent [19]

Oldershaw et al.

[11] 4,350,478

[45] Sep. 21, 1982

[54] BOTTOM HOLE OIL WELL PUMP

[76] Inventors: Paul V. Oldershaw, 4812 Hasti Bob Ct.; James E. Hansen, 3708 S. Real Rd., both of Bakersfield, Calif. 93309; Walter E. Hinds, 1358 Schuyler Rd., Beverly Hills,, Calif. 90210

[21] Appl. No.: 149,331

[22] Filed: May 13, 1980

[51] Int. Cl.[3] ..... F04B 47/06; F04B 21/06; F04B 39/10

[52] U.S. Cl. ..... 417/417; 417/422; 417/571

[58] Field of Search ..... 417/422, 416, 417, 571; 310/34, 35

[56] References Cited

U.S. PATENT DOCUMENTS

| | | | |
|---|---|---|---|
| 1,655,825 | 1/1928 | Schmidt | 417/417 |
| 2,604,049 | 7/1952 | Martin | 417/222 |

*Primary Examiner*—Richard E. Gluck
*Assistant Examiner*—Peter M. Cuomo
*Attorney, Agent, or Firm*—Paul A. Weilein

[57] ABSTRACT

A bottom hole well pump comprising a pump housing supported by a control cable for raising and lowering the housing within tubing in a well, a linear motor within the housing causing reciprocation of a plunger extending into a pumping chamber formed by the housing with inlet and outlet check valves for controlling flow of oil or other liquid into the pumping chamber and from the pumping chamber into the tubing above the pump housing. In one embodiment, Belleville-type springs are employed for storing energy as the plunger approaches its opposite limits of travel in order to initiate movement of the plunger in the opposite direction. In this embodiment, a single pumping chamber is formed above the linear motor with a single-valve block arranged above the pumping chamber and including inlet check valve means for controlling liquid flow into the pumping chamber and outlet check valve means for controlling liquid flow from the pumping chamber into the tubing interior above the pump housing. In another embodiment, pumping chambers are formed above and below the linear motor with a tubular plunger extending into both pumping chambers, in order to achieve pumping during both directions of travel of the plunger.

26 Claims, 4 Drawing Figures

BOTTOM HOLE OIL WELL PUMP

BACKGROUND OF THE INVENTION

The present invention relates to a bottom hole well pump and more specifically to such a pump including a linear action motor for producing reciprocating action of a plunger in one or more pumping chambers.

A number of different types of bottom hole well pumps have been provided in the prior art for raising oil or other liquids from substantial depths underground. Most commonly, the pump assembly may be suspended at a suitable pumping depth in the well while being mechanically operated by a reciprocating sucker rod extending to the surface of the well. Such pumps are generally inefficient, particularly in deep wells because of the need for the reciprocating sucker rod to extend from the surface toward the bottom of the well. At the same time, such pumps have suffered because of the likelihood of mechanical separation along the entire length of the sucker rod.

Accordingly, the prior art has also provided a variety of bottom hole pumps which avoid the need for a mechanically reciprocating rod extending throughout the entire depth of the well. Rather, these pumps include electrically actuated pumping means such as a linear motor interconnected by an electrical conduit with a power source and control means at the surface of the well. Such pumps have been found to be generally efficient and may employ a linear motor in the form of either a solenoid motor, a DC motor or a stepper motor, for example. Pump assemblies of this type have been commonly employed in oil wells which are the major application for this type of pump. A number of different types of electrically operated pumps have been provided particularly for oil wells, as exemplified for example by U.S. Pat. No. 1,287,078, issued Dec. 10, 1918; U.S. Pat. No. 1,655,825, issued Jan. 10, 1928; U.S. Pat. No. 1,840,994, issued Jan. 12, 1932; U.S. Pat. No. 2,222,823, issued Nov. 26, 1940; and U.S. Pat. No. 3,031,970, issued May 1, 1962.

Although electrically operated pump assemblies of this type have been available for many years as indicated by the above patents, the importance of maintaining efficiency and continuity of operation in the pump has become even more important with the greater depth to which such wells must extend at present. Because of the greater depths, it is, of course, more time-consuming and costly in order to raise the pump assembly for making any necessary repairs and for reintroducing it at a suitable pumping depth within the well.

In addition to modern oil wells extending to greater depth, it has also become more common to place in commercial production wells which are of more marginal value. In such wells, the oil may seep into the well at diminishing rates during operation of the well. Accordingly, it may often be necessary during operation of the well to adjust performance of the pump in order to adapt it will the production capabilities of the well.

For these reasons, there has been found to remain a need for an efficient bottom hole pump which may be readily introduced even at great depths into wells of a type including a casing with a tubing of substantially smaller diameter than the casing and extending downwardly therethrough to a depth at which liquid is to be pumped from the well.

SUMMARY OF THE INVENTION

It is therefore an object of the present invention to provide a bottom hole pump suitable for use in wells of the type referred to above and capable of overcoming one or more problems of the type referred to above. In particular, it is a specific object of the invention to provide an integral pump assembly which may be lowered and raised within the tubing of such a well by means of a control cable, the integral pump assembly being adapted for efficient and reliable operation over long periods of time when it is at a suitable pumping depth within the well.

It is a further object of the invention to provide such a bottom hole pump wherein the pump assembly is contained within an elongated pump housing connected at its upper end with a control cable adapted for communication with a power source and controls at the surface of the well, the pump housing being supported by flange means on the tubing at a suitable pumping depth with a portion of the pump housing serving to close the interior of the tubing from the well casing, the upper end of the housing forming an outlet chamber and passage means for communicating the outlet chamber into the tubing thereabove, the pump housing also including a linear motor for producing reciprocating action of a cylindrical plunger extending into a pumping chamber with an inlet check valve communicating liquid from the well casing into the pumping chamber and an outlet check valve communicating liquid from the pumping chamber into the outlet chamber for passage to the tubing interior above the pump housing.

In one embodiment of the invention, the outlet chamber formed at the upper end of the pump housing also serves as a pumping chamber with the plunger being of a hollow tubular configuration with the pump assembly being adapted for producing pumping action during travel of the plunger in both directions.

Within the integral pump assembly construction referred to above, a bottom section of the tubing is of special construction and includes flange means for supporting the pump housing while also being formed from relatively thick steel in order to provide proper permeability for containing magnetic flux density required for improved operation of the linear motors.

Another specific feature of the pump assembly contemplates the arrangement of an equalizing chamber between the linear motor and the pumping chamber in order to protect the motor from excessive pressure variations occurring within the pumping chamber. Also, the pump housing includes a coupling means formed adjacent the linear motor to permit the insertion of additional linear motor sections in order to adjust the stroke of the pump assembly. Similarly, the pumping capacity of the assembly may also be adapted to meet particular conditions by changing the effective diameter of the plunger which is moved in reciprocation within the pumping chamber by the linear motor.

A further object of the invention is to provide a similar pump assembly including a pump housing suspended within the tubing by means of a control cable and including a linear motor with one or more pumping chambers, Belleville-type spring means being associated with the linear motor and having substantial energy storage capacity in order to interact with the plunger as it approaches either limit of reciprocating travel in order to store energy as it brakes the plunger while thereafter serving to initiate travel of the plunger in the opposite direction. In a preferred embodiment of the invention, a separate Belleville-type spring assembly is arranged at opposite ends of the linear motor. However, it will be obvious from the following description that a single Belleville-type spring assembly could serve to interact with the plunger in both directions of travel with the provision of a suitable lost motion coupling between the plunger and the spring assembly.

Another object of the invention is to provide a bottom hole pump of the type generally referred to above with a linear motor and reciprocating plunger arranged within a pump housing, the pump housing also including a pumping chamber formed above the linear motor with the plunger arranged for a reciprocating motion therein, a single valve block closing the upper end of the pumping chamber and including an inlet check valve for communicating liquid from the well casing into the pumping chamber and a second outlet check valve for communicating liquid from the pumping chamber into the tubing interior above the pump housing upon reciprocating movement of the plunger.

Still another object of the invention is to provide a similar pump assembly including a linear motor with pumping chambers formed both above and below the linear motor, a reciprocating plunger being disposed within the linear motor and extending for a reciprocating action into both pumping chambers, the plunger being of tubular configuration and having a travelling check valve mounted thereupon for communicating liquid from the lower pumping chamber to the upper pumping chamber, a fixed check valve being arranged in communication with the lower pumping chamber for admitting liquid from the well casing thereinto.

Additional objects and advantages of the invention will be made apparent in the following description. In particular, it will become apparent from the following description that various features of the bottom hole pump embodiments provided by the present invention may be used in various combinations with each other. Accordingly, it is to be kept in mind that the invention is not limited to the specific combination of features illustrated in the accompanying drawings to which reference is made within the following description.

BRIEF DESCRIPTION OF THE DRAWINGS

Referring to the accompanying drawings, which are for illustrative purposes only.

DESCRIPTION OF THE SEVERAL EMBODIMENTS

The following description relates to the embodiments shown respectively in FIGS. 1–2, and 3–4. Both of the embodiments relate to down hole pumps for oil wells or the like, including a linear motor producing reciprocating motion in a plunger for pumping oil or other liquid from the well through the interior of tubing within which the pump is arranged.

Figure 1:
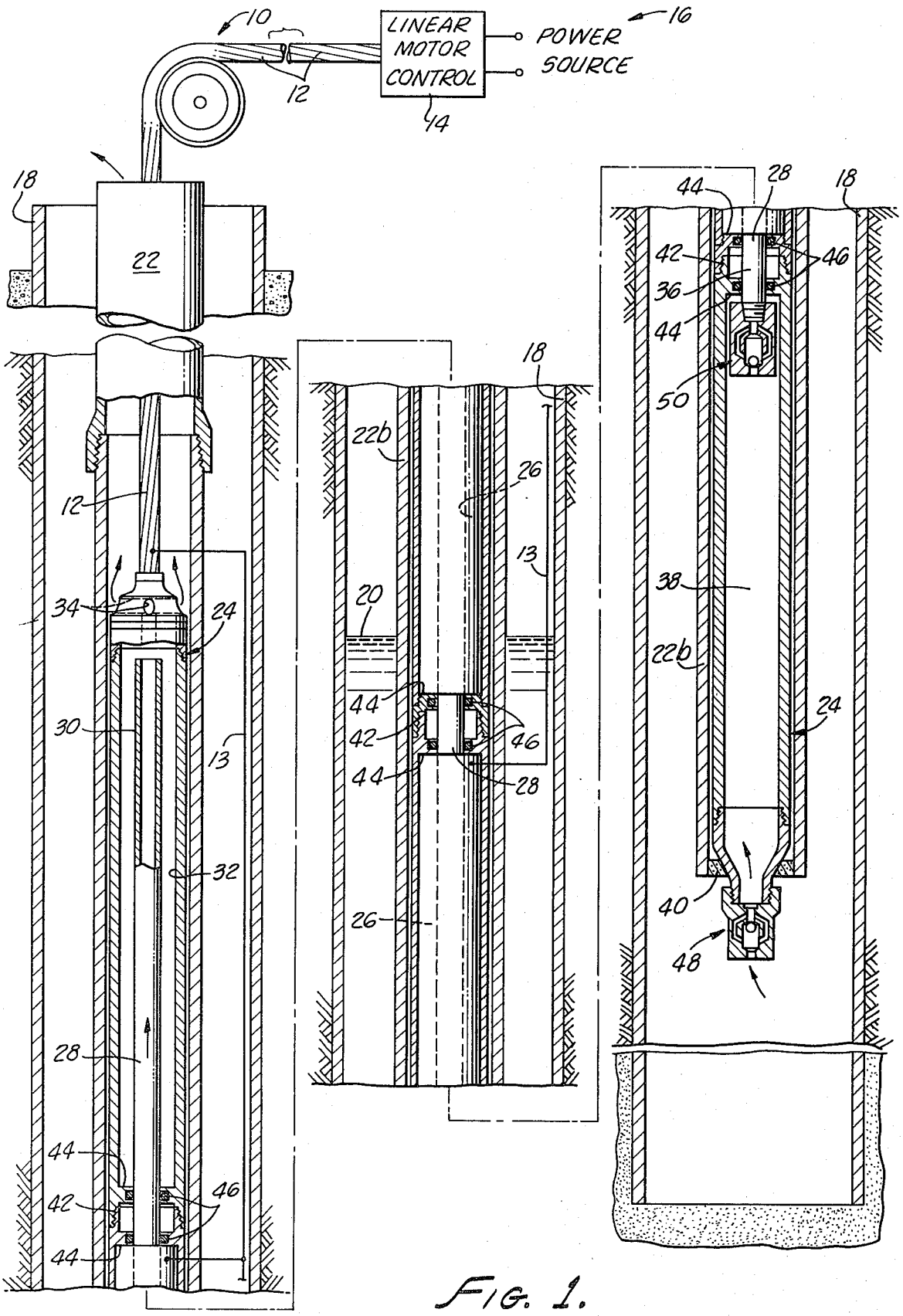
FIG. 1 is a side view of a well containing a bottom hole pump constructed in accordance with the present invention, portions of the well and pump assembly being shown in section in order to better illustrate the invention, and wherein a reciprocating plunger operated by a linear motor within the pump assembly is shown as approaching its uppermost limit of travel.

Referring now to FIG. 1, such a well is generally indicated at 10, a pump control cable 12 being illustrated as being operatively connected through appropriate control circuit connections, as schematically indicated by numeral 13, with a linear motor control module 14, and a power source 16 at the surface of the well. The well includes a relatively large casing 18 which may extend far below the surface of the earth, for example, up to many thousands of feet in the case of oil wells. Only a small portion of the casing 18 is illustrated adjacent the surface of the well, the remainder of the casing being broken apart therefrom and illustrated adjacent a suitable pumping depth where liquid 20 is found standing within the casing 18.

Sectional tubing 22 of substantially smaller diameter than the casing 18 also extends downwardly through the well to the selected pumping depth adjacent or even substantially below the standing level of the liquid 20 within the well. Bottom sections of the tubing 22 are specifically indicated at **22*b*** and are especially adapted for interaction with the bottom hole pump of the present invention, as will be more apparent from the following description.

The bottom hole pump is preferably constructed as an integral assembly contained within a housing 24 for suspension by the control cable 12. In this manner, the pump housing 24 may be raised and lowered within the tubing by the control cable 12 as well as being placed in communication thereby with the motor control module 14 and power source 16. The pump housing is of elongated cylindrical configuration having a diameter adapted for its disposition within the tubing 22. A mid-section of the housing 24 contains a linear motor 26 of the type described above. A cylindrical steel plunger 28 of tubular configuration is arranged coaxially within the linear motor 26, its upper end 30 projecting into a pumping chamber 32.

Figure 2:
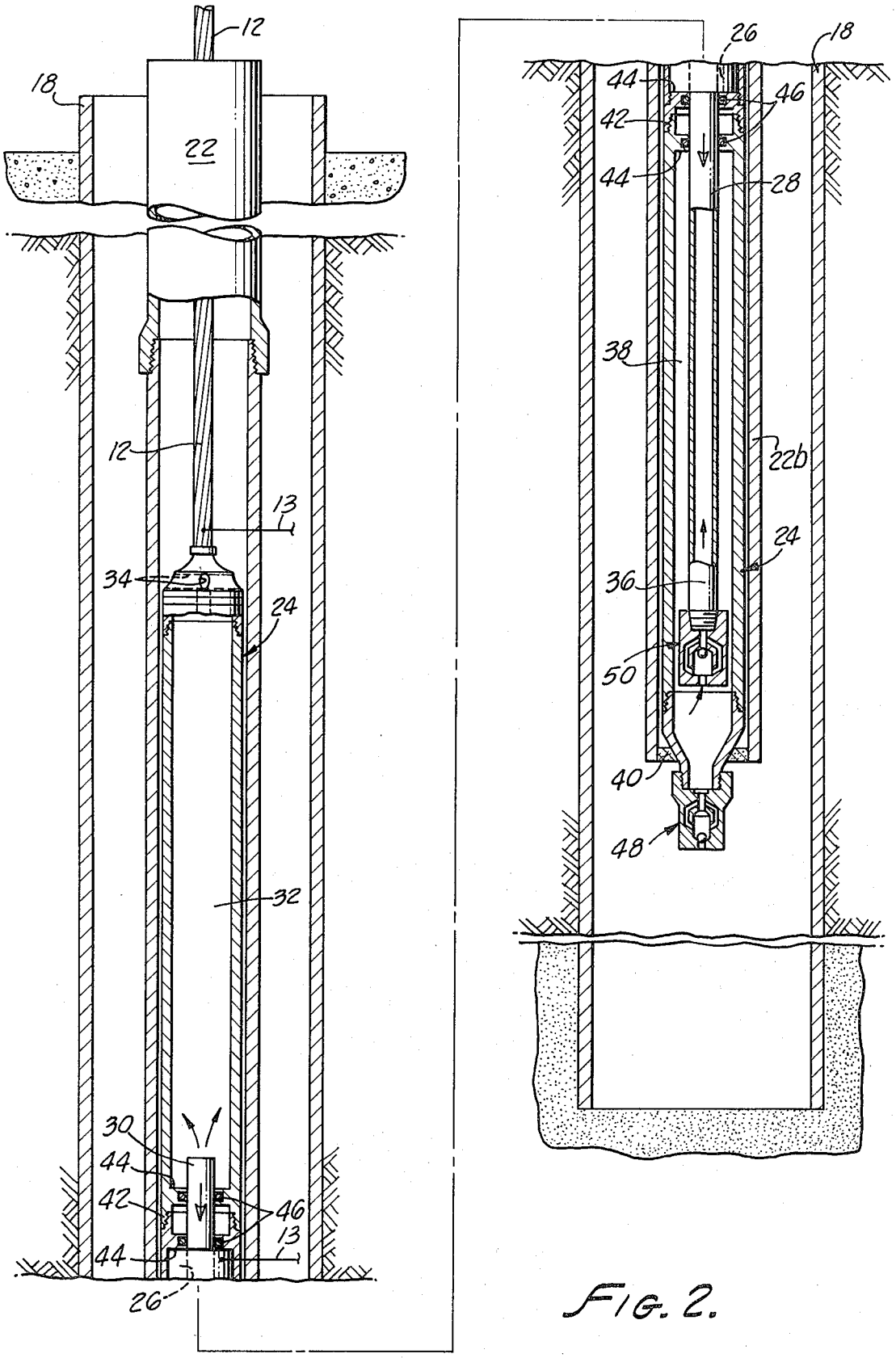
FIG. 2 is a similar view to that of FIG. 1 with the reciprocating plunger being illustrated as approaching its lowermost limit of travel within the pump assembly.

In the configuration of FIGS. 1 and 2, the pumping chamber 32 also serves as an outlet chamber which is in communication with the interior of the tubing 22 above the pump housing 24 by means of passages 34 formed at the upper end of the housing 24 adjacent its interconnection with the control cable 12. The lower end 36 of the plunger 28 extends downwardly into a lower pumping chamber 38.

As indicated above, the lower tubing sections **22*b* are specifically designed for cooperation with the bottom hole pump assembly. In particular, a bracket 40 is formed at the lower end of the bottom tubing section and is of annular configuration for receiving and supporting the lower end of the pump housing 24. The lower end of the pump housing 24 projects through the annular bracket 40 for reasons set forth immediately below. The bottom tubing section or sections 22*b*** of the tubing which are adjacent portions of the linear motor are formed with a relatively thick steel wall in order to provide sufficient permeability to contain the magnetic flux density required for proper operation of the linear motor.

The pump housing 24 is formed by a number of annular sections forming joints 42 adjacent the linear motor and at the juncture between the linear motor and the upper and lower pumping chambers 32 and 38. The housing sections adjacent the joints 42 are formed with annular mounts 44 supporting O-rings 46 for engaging the plunger 28. Thus, the O-rings serve to properly support the plunger within the linear motor and to provide a seal between the pumping chambers and the linear motor as well as between different sections of the motor itself. In addition, an intermediate joint 42 permits the addition of linear motor sections if required, for example, by changed conditions in the well. In such an event, the additional motor sections could be arranged in space originally provided within the housing 24. On the other hand, an additional annular section could be added to the motor with the plunger being modified in order to adapt it for the additional length of the linear motor.

In order to control liquid flow from the well through the pump and into the tubing, a stationary check valve assembly 48 is mounted upon the lower end of the pump housing 24 at the bottom of the lower pumping chamber 38. The stationary check valve assembly 48 serves to admit liquid from the well casing into the lower pumping chamber while preventing reverse flow. A travelling check valve assembly 50 is mounted upon the lower end of the plunger 28 which extends into the lower pumping chamber 38. Here again, the travelling check valve assembly 50 is adapted to permit liquid flow from the lower pumping chamber 38 through the tubular plunger 28 into the upper pumping chamber 32 while preventing flow in the reverse direction.

In operation, the linear motor is operatively controlled by the motor control module 14 through the control cable 12 in a well known conventional manner to produce reciprocating action of the plunger 28. As the plunger 28 travels from its lowermost limit, FIG. 2, towards its uppermost limit, FIG. 1, liquid is drawn in through the stationary check valve assembly 48 to compensate for the removed portion of the plunger 28 from the lower pumping chamber 38. As the plunger 28 then moves downwardly again towards its lowermost limit, the stationary check valve 48 prevents liquid in the lower pumping chamber 38 from flowing back to the well. At the same time, the travelling check valve 50 permits liquid from the lower pumping chamber 38 to flow through the plunger 28 into the upper pumping chamber 32. Also, during upward travel of the plunger 28, liquid is also forced from the upper pumping chamber 32 through the passages 34 into the interior of the tubing above the pump housing and upwardly to the surface of the well.

A modification of the embodiment illustrated in FIGS. 1 and 2 is possible, wherein the lower end of the tubular plunger 28, which extends into the lower pumping chamber 38, is made larger than the upper end of the tubular plunger 28, which extends into the upper pumping chamber 32. With this arrangement, liquid from the pump will also be forced out of the upper pumping chamber 32 through the passages 34 into the tubing interior during the downstroke of the plunger 28 as well as during its upstroke and thereby further increase the pumping capacity.

Figure 3:
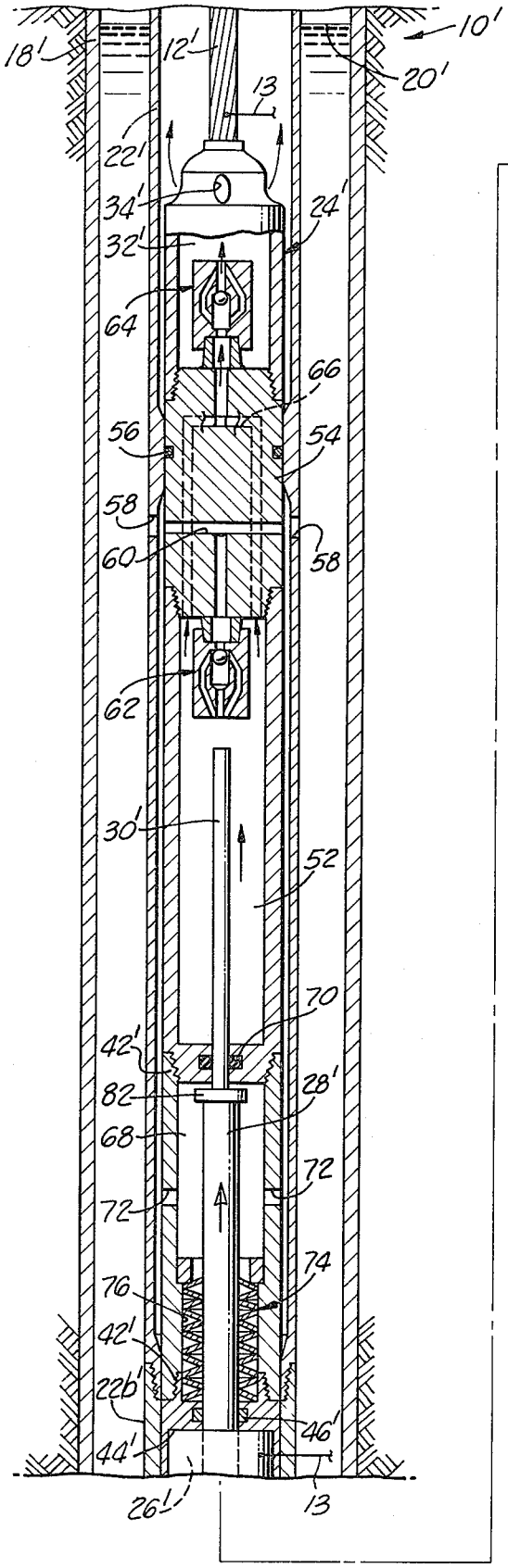
FIG. 3 is a fragmentary side view of a well containing another embodiment of a pump assembly according to the present invention, and wherein a reciprocating plunger operated by a linear motor is illustrated as approaching an uppermost limit of travel.
Figure 3:
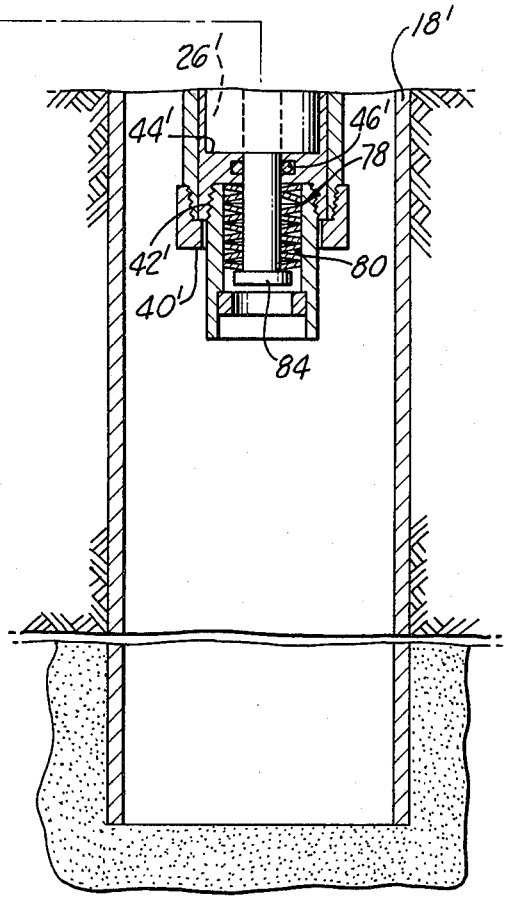
Figure 4:
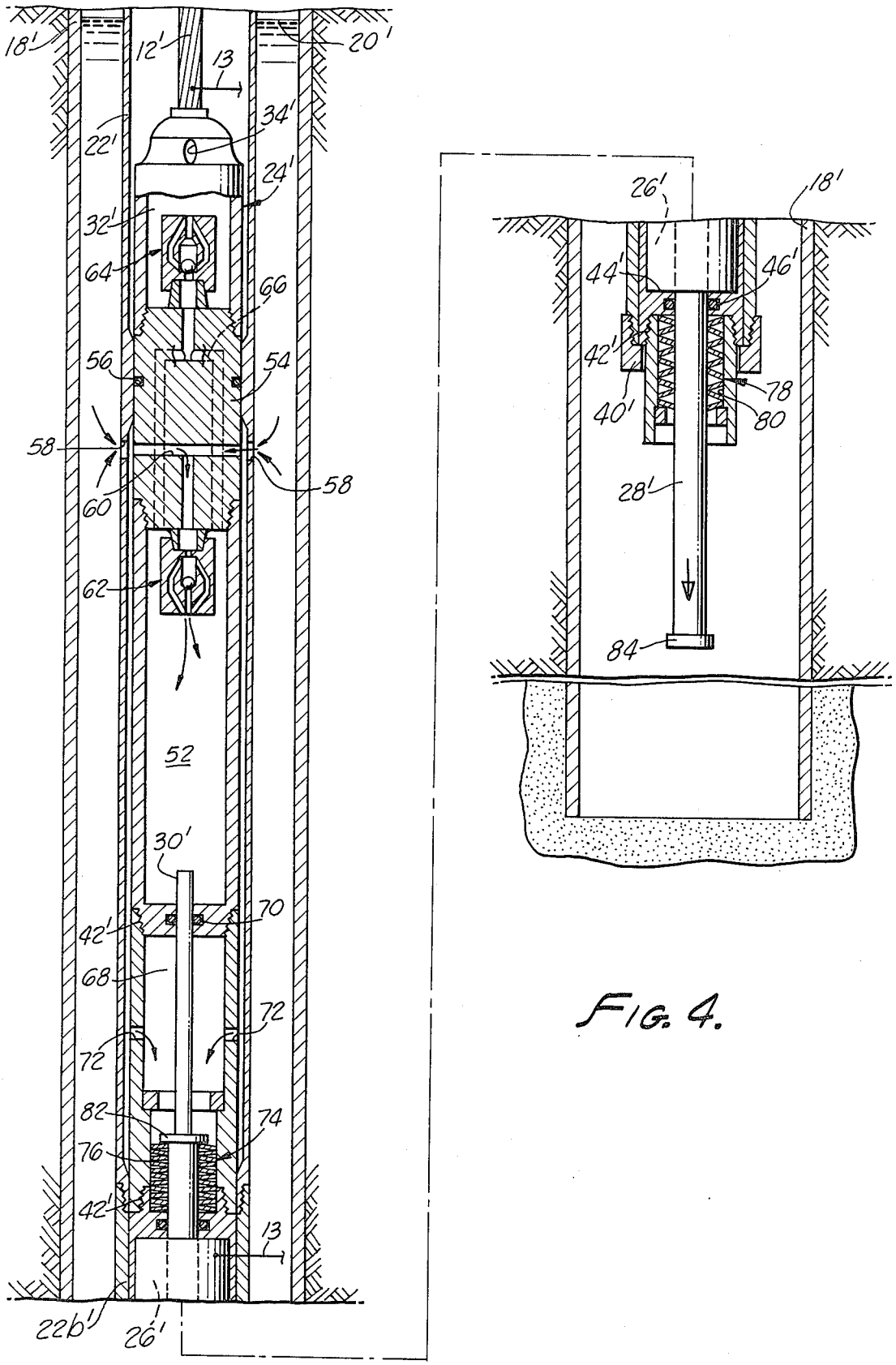
FIG. 4 is a similar view to that of FIG. 3 with the reciprocating plunger approaching its lowermost limit of travel.

Another embodiment of the present invention is illustrated in FIGS. 3 and 4. Since many of the components for both the well and pumping assembly of FIGS. 3 and 4 are similar to components described above with reference to FIGS. 1 and 2, similar primed numerals are employed in connection with FIGS. 3 and 4 to identify those corresponding elements. A similar motor control module and power source would be employed as illustrated in FIGS. 1 and 2 and accordingly have not been shown in FIGS. 3 and 4.

The well 10' is similar to the well 10 of FIGS. 1 and 2 with well casing 18', tubing 22' and a control cable 12' extending downwardly through the tubing to support the pump housing 24'. The lower end of the tubing and the construction of the pump housing 24' are also in accordance with the preceding description for FIGS. 1 and 2 as is the arrangement of the linear motor 26'. However, the plunger 28' of FIGS. 3 and 4 is of solid construction rather than being tubular as in FIGS. 1 and 2. In addition, the linear motor 26' is arranged in the lower end of the pump housing 24', extending downwardly to the bracket 40' which supports the pump housing within the tubing.

In the embodiment of FIGS. 3 and 4, only a single pumping chamber 52 is provided. Preferably, the pumping chamber 52 is positioned above the linear motor. However, it would also be possible within the scope of the present invention to position the single pumping chamber beneath the linear motor. At the same time, the pump housing 24' forms an outlet chamber 32' which corresponds to the upper pumping chamber 32 of FIGS. 1 and 2 in that it is in open communication with the interior of the tubing 22' above the pump housing by means of passages 34'.

The outlet chamber 32' is separated from the single pumping chamber 52 by means of a valve block 54 including annular seal means 56 arranged about its periphery for sealing engagement with the interior wall of the tubing 22'. Inlet ports 58 are formed in the tubing 22' just below the seal 56 in order to admit liquid from the well casing. The valve block 54 includes internal passages 60 for communicating liquid from the inlet ports 58 into the pumping chamber 52 by means of a first check valve assembly 62. A second check valve assembly 64 is also mounted upon the valve block 54 and is in communication with the pumping chamber 52 by separate passages 66 formed in the valve block 54 for communicating liquid from the pumping chamber 52 into the outlet chamber 32'.

In addition, the bottom hole pump of FIGS. 3 and 4 includes a pressure equalizing chamber 68 formed intermediate the pumping chamber 52 and the linear motor 26' in order to isolate the linear motor from higher pressures developed within the pumping chamber. The equalizing chamber 68 is formed by the pump housing 24' with the plunger 28' extending through the equalizing chamber into the pumping chamber 52. An O-ring seal 70 engages the plunger to seal the pumping chamber 52 from the equalizing chamber 68. Liquid entering the tubing through the inlet ports 58 is also admitted into the equalizing chamber 68 by equalizing ports 72 so that the equalizing chamber 68 remains at the same pressure as the liquid or oil within the well casing.

In order to further facilitate operation of the linear motor and to reduce the amount of energy employed for its operation, a Belleville-type spring assembly 74 is arranged in a chamber 76 formed by the pump housing above the linear motor with a similar spring assembly 78 being arranged in a chamber 80 formed by the lower end of the pump housing beneath the linear motor. The plunger 28′ extends into each of the chambers 76 and 80 and includes respective abutment flanges 82 and 84 for engaging the spring assemblies 74 and 78 as the plunger approaches opposite limits of travel under the driving action of the linear motor. The chamber 80 at the lower end of the pump housing is also in communication with liquid in the well casing in order to equalize pressure therein. The Belleville-type spring assemblies are selected to have substantial energy storage capacity in order to enable them to arrest travel on the plunger, the energy thereby being stored in the spring assembly then being employed to initiate travel of the plunger in the opposite direction.

Operation of the embodiment of FIGS. 3 and 4 is believed to be obvious particularly in view of the previous description for the operation of the embodiment in FIGS. 1 and 2. However, it may be briefly noted that the linear motor 26′ is regulated by a motor control module (not shown in FIGS. 3 and 4) in order to cause reciprocating action of the plunger 28′. As noted immediately above, the spring assemblies 74 and 78 assist the linear motor in arresting movement of the plunger as it approaches each limit of travel and in initiating travel of the plunger in the opposite direction. Accordingly, operation of the pump is greatly facilitated while reducing the amount of energy which must be expended by the linear motor at the limits of travel for the plunger. As the plunger reciprocates, it moves upwardly through the pumping chamber 52 to force liquid from the chamber through the passages 66 into the outlet chamber 32′ for passage into the tubing above the pump housing. As the plunger moves downwardly, additional liquid is drawn into the pumping chamber through the ports 58 and the check valve 62. Accordingly, continued reciprocating action of the plunger serves to provide a continuous supply of liquid under pressure into the tubing for transport to the surface.

Numerous modifications will be apprent from the preceding description within the scope of the present invention. For example, within the embodiment of FIGS. 3 and 4, the two Belleville-type spring assemblies 74 and 78 could be replaced by a single spring assembly, a lost motion coupling then being necessary for proper interaction between the plunger and its opposite ends of travel and the spring assembly for arresting travel of the plunger in each direction and initiating its travel in the opposite direction. Other changes will also be apparent from the description. Accordingly, the scope of the present invention is defined only by the following appended claims.

What is claimed is:

1. A bottom hole pump for use in a well including a casing with tubing of substantially smaller diameter than the casing extending downwardly through the casing to a depth at which liquid is to be pumped from the well, comprising:

an elongate pump housing connected at its upper end with a control cable for lowering and raising the pump housing in the tubing and for connecting the pump with an electrical power source and controls at the surface of the well, the tubing including means for supporting the pump housing at a predetermined pumping depth within the well, the upper end of the housing adjacent its interconnection with the control cable forming an outlet chamber and passage means for connecting the outlet chamber with the interior of the tubing above the pump housing;

inlet means for admitting liquid from the well casing into the pump housing;

a pumping chamber in the pump housing;

a linear motor mounted in the pump housing and being operatively interconnected with the control cable;

a cylindrical plunger reciprocable by the linear motor and extending into the pumping chamber for producing a pumping action therein;

an inlet check valve enabling liquid flow through the inlet means into the pumping chamber; and an outlet check valve enabling liquid flow from the pumping chamber into the outlet chamber for passage to the tubing above the pump housing.

2. A bottom hole pump according to claim 1, wherein the tubing adjacent the pump housing is formed from steel and is of a thickness to provide sufficient permeability to contain the magnetic flux density required for operation of the linear motor.

3. A bottom hole pump according to claim 1, which further comprises a Belleville-type spring assembly means arranged in a chamber formed by the pump housing, the plunger including abutment means for engaging the spring assembly means as it approaches its opposite limits of travel, whereby inertial energy of the plunger will be stored in the spring assembly means at each travel limit and serve to initiate movement of the plunger in its opposite direction of travel.

4. A bottom hole pump according to claim 3, in which the spring assembly means comprises separate spring assemblies at opposite ends of the linear motor for interaction with separate abutments on the plunger.

5. A bottom hole pump according to claim 1, wherein the pumping chamber is positioned between the linear motor and the outlet chamber, and a single valve block mounted in the pump housing separates the pumping chamber and the outlet chamber, said valve block including said inlet check valve for admitting liquid from the well into the pumping chamber, and said outlet check valve for admitting liquid from the pumping chamber into the outlet chamber for flow to the interior of the tubing above the pump housing.

6. A bottom hole pump according to claim 5, further comprising a pressure equalizing chamber formed by the pump housing intermediate the linear motor and the pumping chamber, and equalizing passage means connecting the equalizing chamber with liquid in the well.

7. A bottom hole pump according to claim 1, which further comprises an equalizing chamber formed by the pump housing intermediate the linear motor and the pumping chamber, and passage means connecting the equalizing chamber with liquid in the well.

8. A bottom hole pump according to claim 1, wherein the pumping chamber is positioned below the linear motor, the outlet chamber comprises a pumping chamber positioned above the linear motor, the plunger extends into each of the pumping chambers and is of tubular construction, the inlet check valve is mounted upon the pump housing and admits liquid from the well into the pumping chamber that is positioned below the linear motor, and the outlet check valve is mounted upon the plunger and controls flow of liquid from the pumping chamber below the linear motor to the pumping chamber above the linear motor.

9. A bottom hole pump according to claim 1, wherein the pump housing includes coupling means adjacent the linear motor to facilitate access to the linear motor for adding additional sections to adapt the pump for different operating conditions.

10. A bottom hole pump according to claim 1, wherein the pump housing has walls surrounding the linear motor, the pumping chamber and the outlet chamber, and a plurality of wall supported sealing means engaged with said plunger and being operative to sealingly separate interior portions of the housing and support the plunger in operative relation with respect to the pumping chamber and linear motor.

11. A bottom hole pump for use in a well including a casing with tubing of substantially smaller diameter than the casing extending downwardly through the casing to a depth at which liquid is to be pumped from the well, comprising:

an elongate pump housing connected at its upper end to a control cable for lowering and raising it in the tubing, the housing being located in the tubing during operation at a predetermined pumping depth within the well;

a pumping chamber in the pump housing;

a linear motor in the pump housing having power supply connections with the control cable;

a cylindrical plunger reciprocable by the linear motor, and extending into the pumping chamber for producing a pumping action therein;

inlet and outlet check valve means for controlling liquid flow from the well into the pumping chamber and from the pumping chamber into the tubing above the pump housing;

spring receiving chamber means formed within the pump housing adjacent the linear motor and having a portion of the plunger therein;

annular seal means intermediate the linear motor and said spring chamber means having sealing engagement with the plunger; and Belleville-type spring assembly means of substantial energy storage capacity positioned within said spring chamber means and arranged for interaction with abutment means on said plunger as it approaches its opposite limits of travel, whereby inertial energy of the plunger will be stored in the spring assembly means at each travel limit and serve to initiate movement of the plunger in its opposite direction of travel.

12. A bottom hole pump according to claim 11, wherein the spring assembly means comprises a separate Belleville-type spring assembly in a chamber at each end of the linear motor, and each spring assembly interacts with separate abutment means on said plunger.

13. A bottom hole pump according to claim 12, wherein the pump housing includes annular walls for separating the linear motor from the spring assembly chambers, and said annular walls comprising seal means for sealing engagement with the plunger and for supporting the plunger in operative relation with respect to the linear motor.

14. A bottom hole pump according to claim 11, further comprising a pressure equalizing chamber formed between the linear motor and the pumping chamber, the equalizing chamber being in communication with the well externally of the tubing and being operative to isolate the linear motor from excessive pressures in the pumping chamber.

15. A bottom hole pump according to claim 11, wherein the pump housing includes coupling means adjacent the linear motor to provide access for modifying it to meet different pumping conditions.

16. A bottom hole pump for a well of the type including a casing with tubing of substantially smaller diameter than the casing extending downwardly through the casing to a depth at which liquid is to be pumped from the well, comprising:

an elongate pump housing connected at its upper end with a control cable for lowering and raising the pump housing in the tubing and for connecting the pump with an electrical power source and controls at the surface of the well, the pump housing contacting the lower end of the tubing in order to close the tubing interior from the well;

a linear motor mounted in the pump housing and being operatively interconnected with the control cable;

a cylindrical plunger reciprocable by the linear motor;

a pumping chamber in the pump housing above the linear motor, the plunger extending into the pumping chamber for reciprocating pumping action therein;

a valve block mounted in the pump housing closing the upper end of the pumping chamber;

inlet means connecting the liquid in the casing with the valve block; and said valve block includes an inlet check valve for controlling liquid flow from the inlet means into the pumping chamber, and an outlet check valve for controlling liquid flow from the pumping chamber into the tubing above the pump housing.

17. A bottom hole pump according to claim 16, further comprising annular seal means interposed between the pump housing and the tubing adjacent the valve block, and the inlet means being formed as ports in the tubing below the seal.

18. A bottom hole pump according to claim 17, wherein the inlet check valve is mounted at the bottom of the valve block, and passage means connects the inlet means with the inlet check valve, the outlet check valve is mounted at an upper portion of the valve block and passage means connects the pumping chamber with the outlet check valve.

19. A bottom hole pump according to claim 16, wherein the inlet check valve is mounted at the bottom of the valve block, a passage connects the inlet means with the inlet check valve, the outlet check valve is mounted at an upper portion of the valve block, and a separate passage connects the pumping chamber with the outlet check valve.

20. A bottom hole pump according to claim 16, further comprising a pressure equalizing chamber formed by the pump housing between the linear motor and the pumping chamber and including means for sealing the equalizing chamber with respect to the linear motor and the pumping chamber, said equalizing chamber being in communication with the casing externally of the tubing and being operative to isolate the linear motor from excessive pressure changes in the pumping chamber.

21. A bottom hole pump according to claim 16, wherein the pump housing includes coupling means adjacent the linear motor to permit access to the linear motor to adapt it for different pumping conditions.

22. A bottom hole pump according to claim 1, in which:

said cylinder plunger is tubular and extends from opposite ends of the linear motor;

the pumping chamber includes upper and lower pumping chambers respectively formed by the pump housing at the upper and lower ends of the linear motor, and the plunger extends into each pumping chamber for reciprocating pumping action therein;

seal means are engageable with the plunger between each end of the linear motor and the associated pumping chamber;

the inlet means includes a stationary check valve at the lower end of the lower pumping chamber for controlling liquid flow from the well casing into the lower pumping chamber;

the outlet check valve comprises a travelling check valve carried by the tubular plunger and positioned in the lower pumping chamber for controlling liquid flow from the lower pumping chamber through the tubular plunger into the upper pumping chamber; and the passage means connects the upper pumping chamber with the tubing interior above the pump housing.

23. A bottom hole pump according to claim 22, wherein the plunger extending into the lower pumping chamber is of larger diameter than the plunger extending into the upper pumping chamber, in order to achieve increased pumping capacity.

24. A bottom hole pump according to claim 22, wherein the tubing adjacent the pump housing is formed from steel and is of a thickness to provide sufficient permeability to contain the magnetic flux density required for operation of the linear motor.

25. A bottom hole pump according to claim 22, wherein the pump housing includes annular walls positioned between the linear motor and the pumping chambers, and respectively include seal means for engaging the plunger and being operative to isolate the respective portions of the pump housing interior and to support the plunger in operative relation with respect to the linear motor.

26. A bottom hole pump according to claim 22, wherein the pump housing includes coupling means adjacent the linear motor to facilitate access to the linear motor for adding additional sections to adapt the pump for different operating conditions.

* * * * *